US008235615B2

(12) United States Patent
Yarlagadda

(10) Patent No.: US 8,235,615 B2
(45) Date of Patent: Aug. 7, 2012

(54) PERSONAL CARE PRODUCT DISPENSERS AND METHODS OF PACKAGING A PERSONAL CARE PRODUCT

(75) Inventor: Travis T. Yarlagadda, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 433 days.

(21) Appl. No.: 12/645,764

(22) Filed: Dec. 23, 2009

(65) Prior Publication Data

US 2011/0150556 A1 Jun. 23, 2011

(51) Int. Cl.
*B43K 21/027* (2006.01)
*A45D 40/02* (2006.01)
*B43K 5/06* (2006.01)

(52) U.S. Cl. ..... 401/55; 401/87; 401/176; 401/99

(58) Field of Classification Search ..... 401/49, 401/52, 55, 82, 87, 99, 101, 143, 174, 176, 401/179, 187

See application file for complete search history.

(56) References Cited

U.S. PATENT DOCUMENTS 5,833,382 A * 11/1998 Jenks et al. ..... 401/82
7,306,442 B2 * 12/2007 Fox ..... 425/87
8,066,443 B2 * 11/2011 Thiebaut et al. ..... 401/82

FOREIGN PATENT DOCUMENTS

WO WO03/015569 A1 2/2003

* cited by examiner

*Primary Examiner* — David Walczak
*Assistant Examiner* — Jennifer C Chiang
(74) *Attorney, Agent, or Firm* — David K. Benson

(57) ABSTRACT

Personal care product dispensers include a housing, a platform, a personal care product, a hydraulic mechanism, and a tab. The housing has a main opening and an interior compartment. The platform is disposed within the interior compartment of the housing. The personal care product is disposed on the platform. The hydraulic mechanism is in operable communication with the platform. The tab is operatively coupled to the hydraulic mechanism. The hydraulic mechanism is configured to exert a force against the platform to advance the platform and the personal care product through the interior compartment of the housing in response to user manipulation of the tab.

20 Claims, 2 Drawing Sheets

PERSONAL CARE PRODUCT DISPENSERS AND METHODS OF PACKAGING A PERSONAL CARE PRODUCT

TECHNICAL FIELD

The inventive subject matter generally relates to personal care product packaging, and more particularly relates to personal care product dispensers.

BACKGROUND

Antiperspirants and deodorants are popular personal care products used to prevent or eliminate sweat and body odor caused by sweat. Antiperspirants typically prevent the secretion of sweat by blocking or plugging sweat-secreting glands, such as those located at the underarms. Deodorants counteract or mask the unwanted odors caused by bacterial flora in secreted sweat.

Antiperspirant and/or deodorant products may be dispensed in various manners. In some cases, the product may be supplied as a solid product material housed in a container having an open end through which access to the product material may be provided. The product material may be disposed on a screw-type elevating mechanism which extends through a portion of the container and can be driven by a rotatable handwheel. In order to advance the product toward an opening in the container, the handwheel may be rotated in a first (e.g., clockwise) direction to a particular position to thereby extend a portion of the product material beyond the container opening. If desired, the handwheel alternatively may be rotated in an opposite (e.g., counter-clockwise) direction to retract the product material into the container. However, for some users, the rotatable handwheel may be relatively difficult to rotate.

Accordingly, it is desirable to have improved mechanisms for dispensing antiperspirant and/or deodorants that are easier to use than conventional rotatable handwheel configurations. In addition, it is desirable for the improved mechanisms to be relatively simple to manufacture. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Personal care product dispensers and methods of packaging a personal care product are provided.

In an embodiment, by way of example only, a dispenser includes a housing, a platform, a personal care product, a hydraulic mechanism, and a tab. The housing has a main opening and an interior compartment. The platform is disposed within the interior compartment of the housing. The personal care product is disposed on the platform. The hydraulic, mechanism is in operable communication with the platform. The tab is operatively coupled to the hydraulic mechanism. The hydraulic mechanism is configured to exert a force against the platform to advance the platform and the personal care product through the interior compartment of the housing in response to user manipulation of the tab.

In another embodiment, by way of example only, a dispenser includes a housing, a platform, a personal care product, a tab, and a hydraulic mechanism. The housing has a main opening, an interior compartment, and a slot. The platform is disposed within the interior compartment of the housing. The personal care product is disposed on the platform. The tab at least partially extends through the slot. The hydraulic mechanism is in operable communication with the platform and the tab. The hydraulic mechanism includes a first piston, a second piston, and a fluid compartment, where the first piston operatively couples to the tab and slidably engages with the fluid compartment, the second piston operatively couples to the platform and slidably engages with the fluid compartment, and the fluid compartment defines a channel extending and providing fluid communication between the first piston and the second piston. The hydraulic mechanism is configured to exert a force against the platform to advance the platform and the personal care product through the interior compartment of the housing in response to user manipulation of the tab.

In still another embodiment, by way of example only, a method includes providing a housing having a main opening, an interior compartment, and a cover disposed over the main opening, and inserting an encasement mechanism into the housing to enclose the personal care product within the housing, the encasement mechanism including a platform and a hydraulic mechanism, the encasement mechanism disposed such that the platform contacts the product material, and the hydraulic mechanism contacts the platform.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
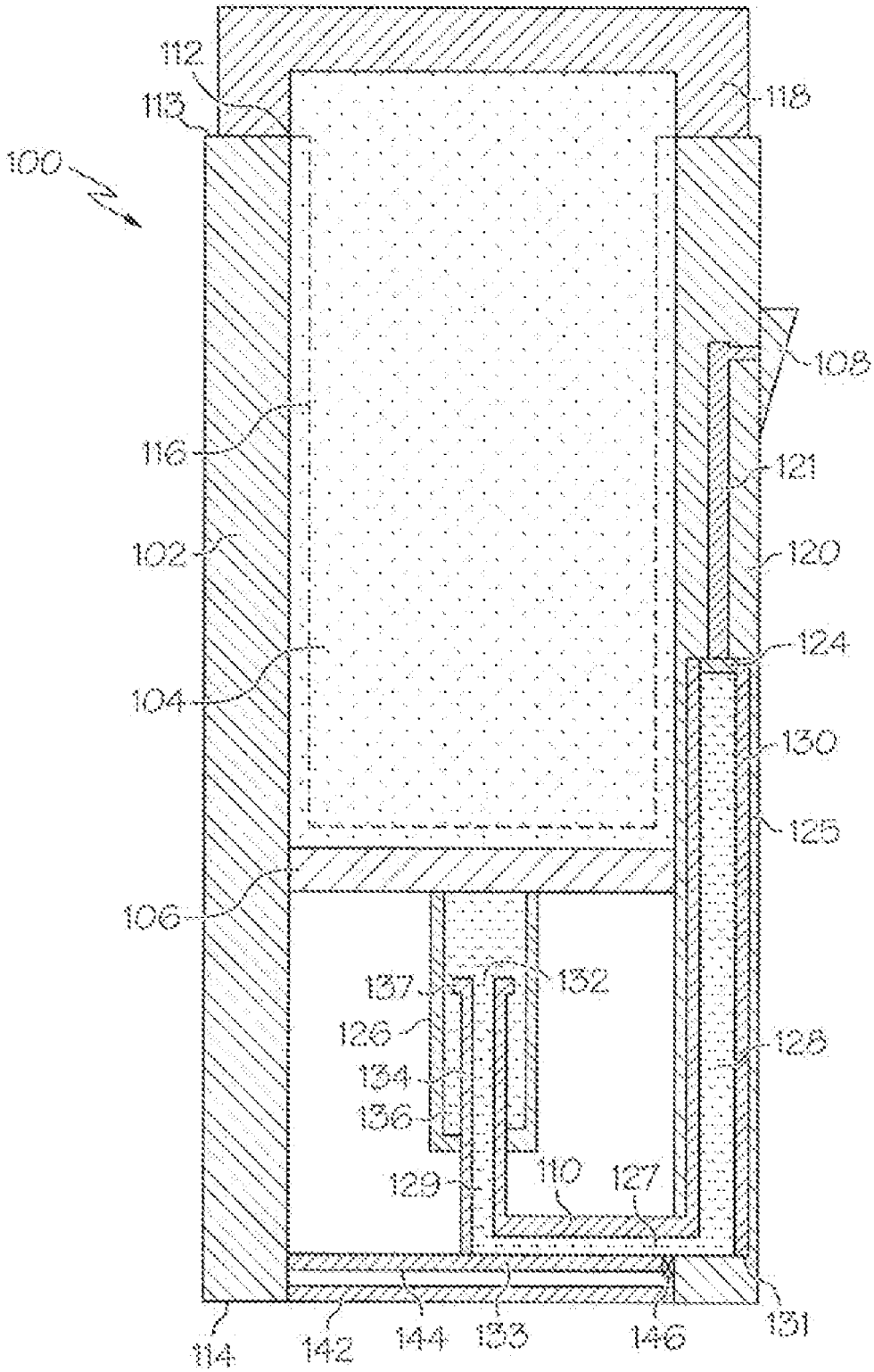
FIG. 1 is a simplified, cross-sectional view of an antiperspirant and/or deodorant dispenser, according to an embodiment.

FIG. 1 is a simplified, cross-sectional view of an antiperspirant and/or deodorant dispenser 100, according to an embodiment. The dispenser 100 may be employed for dispensing a spreadable cosmetic, health and beauty product, or other personal care product material, such as an antiperspirant and/or deodorant. In accordance with an embodiment, the dispenser 100 includes a housing 102, a product material 104, a platform 106, a tab 108, and a hydraulic mechanism 110. In an embodiment, the housing 102 is generally tubular and includes a first end 113 and a second end 114. Housing 102 may have a main opening 112 at the first end 113. An interior compartment of the housing 102, which is open at the main opening 112, is defined by interior sidewalls of the housing 102. The housing 102 is configured to house at least the product material 104, the platform 106, and a portion of the hydraulic mechanism 110. In this regard, the housing 102 may have a circular, ovular, rectangular or other radial cross-sectional shape. In an embodiment, the housing 102 may have a length in a range of about 2 centimeters (cm) to about 8 cm, a width in a range of about 2 cm and about 8 cm, and a height in a range of about 8 cm to about 15 cm. In other embodiments, the housing 102 may have larger or smaller dimensions than the aforementioned ranges. According to an embodiment, the housing 102 may comprise a relatively lightweight, durable material such as plastic, metal, ceramic, glass, or any combination of the aforementioned materials.

In an embodiment, the sidewalls of the interior compartment of the housing are shaped to correspond to a desired configuration of an outer surface of the product material 104. The main opening 112 defined by the ends of the sidewalls allows the product material 104 to be dispensed. In an embodiment, the platform 106 may define a bottom wall of the compartment. In another embodiment, the housing 102 may include a container 116 (shown in phantom) having an outer surface and an inner surface, where the outer surface corresponds to a configuration of the inner surface of the housing 102, and the inner surface defines sidewalls of the compartment for the product material 104. In such case, the main opening 112 may coincide with an opening of the container 116. In an embodiment, the container 116 may have a bottom wall (shown in phantom), which may be located substantially opposite the main opening 112, and the platform 106 may be disposed in contact with the bottom wall. In another embodiment, the container 116 may have another open end that is substantially opposite the main opening 112, and the platform 106 may be disposed over the open end to form a bottom wall. According to an embodiment, the platform 106 may comprise a relatively flat plate, grid, mesh or a combination thereof. In any case, the platform 106 is configured to transmit a force against the container 116 or against the product material 104 to advance or retract the material 104 within the housing 102.

The product material 104 may comprise a solid formulation of an antiperspirant, deodorant, or another personal care product, in an embodiment. In other embodiments, the product material 104 may comprise a formulation for delivering a spreadable cosmetic or personal care product, such as the antiperspirant or the deodorant, over a user's skin. The product material may have a configuration suitable for delivery to the user's skin, including, but not limited to, a gel, solid, paste, liquid, a heated solid configuration transformed into a molten configuration or another material configuration.

According to an embodiment, a cap 118 may be disposed over the main opening 112 to prevent contamination of the product material 104 when not in use. Although the main opening 112 and cap 118 are shown as being located at an end of the housing 102, they may be located at a different portion of the housing 102, in other embodiments.

The tab 108 is configured to transmit pressure through the hydraulic mechanism 110 to the platform 106 to advance the product material 104 through the housing 102 and/or to retract the product material 104 into the housing 102. In an embodiment, the tab 108 communicates with the hydraulic mechanism 110 and provides a means by which the user may control the advancement or retraction of the product material 104. In accordance with an embodiment, the tab 108 may comprise a relatively robust structure that may be depressed, pushed or otherwise receive pressure imparted by an external force (e.g., a user). The tab 108 may have a square shape, triangular-shape (as shown), pyramid shape, cone shape, cube shape or another shape. In other embodiments, the tab 108 may include a flat, rounded or other shaped surface, which may be configured to provide a comfortable tactile surface for the user's thumb or finger.

Figure 2:
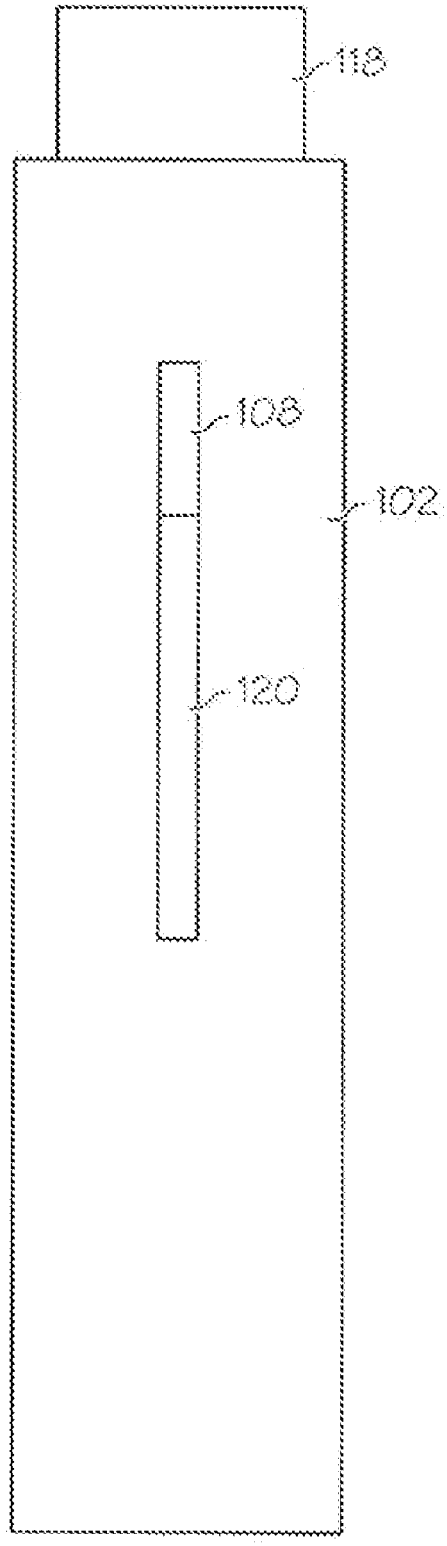
FIG. 2 is an exterior side view of the dispenser of FIG. 1, according to an embodiment.

In an embodiment, the tab 108 protrudes through a slot 120 formed in the housing 102. The slot 120 may extend along a dimension of the housing 102. For example, as shown in FIG. 2, the slot 120 may extend in a substantially straight line along a portion of the height of the housing 102 (e.g., along a portion of a side of the housing). Alternatively, the slot 120 may extend along a different portion of the housing 102. In another example, the slot 120 may extend around a portion of the circumference of the housing 102. In such an embodiment, the slot 120 may form a spiral shape or another shape through the housing 102. In an embodiment, the slot 120 may have a length that corresponds with a distance between the platform 106 and the main opening 112 when the platform 106 is positioned at its furthest point from the main opening 112. In other embodiments, the length of the slot 120 may be longer or shorter than the distance between the platform 106 and main opening 112. In any case, the length of the slot 120 may depend on a particular configuration of the tab 108 and the hydraulic mechanism 110.

The hydraulic mechanism 110 is generally fixed in position with respect to the housing 102, although it may have certain components (e.g., tab 108 and pistons 124, 126) that are movable with respect to the housing 102. Hydraulic mechanism 110 is disposed in operable communication with the platform 106, in an embodiment. For example, the hydraulic mechanism 110 is disposed between the tab 108, and the platform 106 and includes a first piston 124, a second piston 126, and a fluid compartment 128, in an embodiment. As used herein, the term "piston" means a component configured to slidably engage with the interior or exterior sidewalls of a shaft or channel.

In an embodiment, the first piston 124 is operatively coupled to the tab 108. For example, the tab 108 may directly extend from the first piston 124 as a protrusion. In another embodiment, the tab 108 may comprise a separate component that is attached to the first piston 124, such as by an epoxy, by a snap-fit mechanism or another attachment mechanism. In still another embodiment, the slot 120 extends down a portion of the side of the housing 102 that is not adjacent to the fluid compartment 128, and a stem 121 extends from the tab 108 to a top of the first piston 124. In this embodiment, the stem 121 pushes the first piston 124 down from the top, and the fluid compartment 128 is sealed despite the slot 120.

The fluid compartment 128 includes a channel that is defined by sidewalls of the housing 120 and/or the hydraulic mechanism 110, and is sealed at one end by the first piston 124 and at a second end by the second piston 125. Fluid compartment 128 extends between the first piston 124 and the second piston 126 and includes two openings 130, 132 that fluidly communicate with pistons 124, 126, respectively. According to an embodiment, fluid compartment 128 includes a first channel 125 extending adjacent to a side of the dispenser 100 between the first opening 130 and a bottom/side region 131 of the dispenser 100, a second channel 127 extending adjacent a bottom of the dispenser 100 between the bottom/side region 131 of the dispenser 100 and a bottom/central region 133 of the dispenser 100, and a third channel 129 extending between the bottom/central region 133 of the dispenser 100 and the second opening 132. The fluid compartment 128 defines a chamber that includes a substantially incompressible fluid. In an embodiment, the fluid may comprise oil. In other embodiments, the fluid may comprise another liquid typically employed for hydraulic applications (e.g., water or some other fluid).

The second piston 126 is configured to operatively communicate with the platform 106. Thus, when the user depresses or otherwise moves the tab 108, the first piston 124 translates the motion of the tab 108 into a force that is transmitted through the fluid to the second piston 126 and then to the platform 106. The platform 106 then advances the product material 104 through the housing 102 (e.g., when the piston 124 moves in a downward direction and exerts a positive force on the fluid) or retracts the product material 104 into the housing 102 (e.g., when the piston 124 is moved in an upward direction and exerts a negative force on the fluid).

Particular configurations and dimensions of the first piston 124, second piston 126, and the portions of the fluid compartment 128 may depend on a particular configuration the interior of the housing 102. In an embodiment, the first piston 124 may be disposed within and slidably engage with the first channel 125. The first channel 125 may have a first length in a range of about 6 cm to about 14 cm, the second channel 127 may have a second length in a range of about 1 cm to about 5 cm, and the third channel 129 may have a second length in a range of about 6 cm to about 14 cm. According to an embodiment, the first, second, and third channels 125, 127, 129 may have average flow areas in a range of about 0.5 $cm^2$ to about 13 $cm^2$. In other embodiments, the dimensions and/or flow areas of the channels 125, 127, 129 may be greater or less than the aforementioned ranges. Although FIG. 1 illustrates the first piston 124 as being disposed within and slidably engaged with a single channel 125, the first piston 124 may include multiple parts that are disposed within and slidably engaged with more than one channel, in alternate embodiments. The first piston 124 may be configured to extend along a portion of a height of the housing 102, in an embodiment.

According to an embodiment, the second piston 126 may be implemented as a hollow shall that defines an interior chamber 136 of the second piston 126. In an embodiment, the second piston 126 is configured to slidably engage with and telescope with respect to a hollow shaft 134 that defines the third channel 129. In another embodiment, the second piston 126 may include an opening through which the hollow shall 134 is disposed. The opening may be sized in such a manner that an exterior surface of the hollow shaft 134 seals the interior chamber 136 of the second piston 126. In an alternate embodiment, a gasket or other sealing mechanism may be disposed within or in proximity to the opening of the second piston 126 to seal the interior chamber 136 of the second piston 126. The hollow shaft 134 and the second piston 126 may be disposed substantially concentric to each other. The hollow shaft 134 and the second piston 126 may be configured to move between a contracted configuration and an expanded configuration, in response to user manipulation of the tab 108 and the resulting pressure on the fluid that is exerted by the first piston 124.

In an embodiment, the hollow shaft 134 may have a length in a range of about 3 cm to about 7 cm, and the second piston 126 may have a length in a range or about 3 cm to about 7 cm. In other embodiments, the lengths may be greater or less than the aforementioned range. The second piston 126 and the hollow shaft 134 may have substantially equal lengths, or the second piston 126 may be longer or shorter than the hollow shaft 134, in various embodiments. The average flow areas of the shafts 134, 136 may be dependent upon the force to be transmitted from the first piston 124. In an embodiment, the average flow area of the hollow shaft 134 may be smaller than that of the interior chamber 136 of the second piston 126. According to an embodiment, the average flow area of the hollow shaft 134 may be in a range of about 0.5 $cm^2$ to about 13 $cm^2$, and the average flow area of the interior chamber 136 may be in a range of about 0.5 $cm^2$ to about 13 $cm^2$. In other embodiments, the flow areas of the hollow shaft 134 and/or interior chamber 136 may be greater or less than the aforementioned ranges. In an embodiment, one or more flanges 137 may extend radially outwardly from an end or exterior sidewall of the hollow shaft 134 to stop the relative expansion between the hollow shaft 134 and the second piston 126 (e.g., to prevent the hollow shaft 134 and second piston 126 from disengaging). Although the hollow shaft 134 is depicted as being disposed within and slidably engaged with the second piston 126, another configuration may include the second piston 126 as being disposed within and slidably engaged with interior sidewalls of the hollow shaft 134 (e.g., in a more typical piston and cylinder arrangement). In such a configuration, the second piston 126 may or may not include an interior chamber.

In accordance with an embodiment, the second piston 126 may be in operative communication with the platform 106. For example, the second piston 126 may be coupled to the platform 106. In an embodiment, the platform 106 encloses a top portion of the interior chamber 136 of the second piston 126 to contain hydraulic fluid therein. In another example, the second piston 126 may include a top portion that encloses the end of the second piston 126 that is in contact with the platform 106. Accordingly, the second piston 126 may be configured to extend along a portion of the height of the housing 102, in an embodiment as depicted in FIG. 1. In other embodiments, the second piston 126 may extend along a width of the housing 102.

The fluid compartment 128, which is depicted as extending from the first piston 124 to the top of the hollow shaft 134, may occupy a portion of space proximate to the product material 104, in an embodiment. In accordance with an embodiment, the fluid compartment 128 may have a circular, oval, rectangular or another cross-sectional shape. In an embodiment, the fluid compartment 128 may have a total length in a range of about 6 cm to about 14 cm and a width or diameter in a range of about 1 cm to about 4 cm. In other embodiments, the dimensions of the fluid compartment 128 may be greater or less than the aforementioned ranges, depending on particular dimensions of the pistons 124, 126 and the housing 102.

To prevent pressure buildup within the hydraulic mechanism 110, an overflow compartment 142 may be included proximate to the fluid compartment 128. In an example, the overflow compartment 142 may be a separate container disposed adjacent to the fluid compartment 128. In another embodiment, the overflow compartment 142 may comprise an isolated chamber adjacent to the fluid compartment 128 and separated from the overflow compartment 142 by a common wall 144. To configure the overflow compartment 142 such that it receives hydraulic fluid from the fluid compartment 128 when a pressure differential between the overflow compartment 142 and the hydraulic mechanism 110 is greater than a threshold pressure, a release valve 146 may be disposed between the overflow compartment 142 and the fluid compartment 128. The release valve 146 may be included in the common wall 144 or may be disposed in a conduit providing communication between the overflow compartment 142 and the fluid compartment 128. In accordance with an embodiment, the release valve 146 may be a pressure relief-type valve, pressure regulating-type valve or another valve capable of remaining in a closed position, when the pressure differential is substantially equal to or below the threshold pressure, and opening when the pressure differential is above the threshold pressure. In an embodiment, the threshold pressure may be in a range of about 35 psi to about 90 psi. In other embodiments, the threshold pressure may be greater or less than the aforementioned range.

In an embodiment, for case of packaging, the hydraulic mechanism 110 may be cast, pre-assembled or otherwise manufactured as a single component, which is configured to be coupled with the housing 102 (e.g., snap fit, fastened or adhered). For example, the pistons 124, 126 and the structural materials defining the walls of the fluid compartment 128 may be formed as a single component. In another example, the tab 108 may be pre-coupled to the first piston 124 and may be included in the single component. In still another embodiment, the overflow compartment 142 and the release valve 146 may be formed as part of the single component. According to an embodiment, the pistons 124, 126 and the structural materials defining the walls of the fluid compartment 128 and the overflow compartment 142 may comprise relatively lightweight, durable material such as plastic, metal, ceramic, glass, or any combination of the aforementioned materials.

In accordance with an embodiment, to assemble a dispenser configured according to the embodiments described above, the housing 102 may be provided including the cap 118 disposed over the main opening 112 to form a reservoir for receiving the product material. In other embodiments, the cap 118 may not be included, but a temporary cover suitable for closing the main opening 112 alternatively may be included. To increase efficiency in processing, more than one housing 102 may be included in an assembly line, and the housings 102 may be disposed within wells that temporarily enclose the main opening 112. Each well may or may not include a cap 118 disposed therein.

After the housing 102 and cap 118 (if included) are suitably positioned, the product material is dispensed into the housing 102 (e.g., through an opening in the bottom of the housing 102). For example, the housing 102 may include interior walls defining a compartment within which the product material is to reside, and the product material may be dispensed into the compartment. In another embodiment, a container 116 may be provided, the product material may be dispensed into the container 116, and the container 116 and product material may be inserted into the interior compartment of the housing 102. In still another embodiment, the container 116 may include the product material and may be placed within the housing 102. The product material may be dispensed in the form of a gel, a solid or a liquid or molten material that solidifies to form a solid paste, in various embodiments.

In an embodiment, an encasement mechanism is placed over the product material. In an embodiment, the encasement mechanism is configured to enclose the product material within the housing 102 (e.g., from the bottom, as viewed in FIG. 1). Thus, in an embodiment, the encasement mechanism may comprise a component that includes the platform 106. In another embodiment, the encasement mechanism includes the platform 106 and the hydraulic mechanism 110. In yet another embodiment, the encasement mechanism may include the platform 106, the hydraulic mechanism 110, the overflow compartment 142, and the valve 146. In still yet other embodiments, more or fewer components may be included as part of the encasement mechanism.

In an embodiment in which the hydraulic mechanism 110 is not included as part of the encasement mechanism, the hydraulic mechanism 110 may be disposed within the housing 102 such that a portion of the mechanism 110, for example, the second piston 126 contacts or is otherwise in operative communication with the platform 106. According to an embodiment, the tab 108 may be included as part of the hydraulic mechanism 110 and may be inserted through the slot 120 of the housing 102. In another embodiment, the tab 108 may be a separate piece and a portion of the tab 108 may be inserted through the slot 120 of the housing 102 from outside of the housing and separately attached to the first piston 124, after the hydraulic mechanism 110 is disposed within the housing 102. In embodiments in which the overflow compartment 142 is configured as a separate component from the hydraulic mechanism 110, the overflow compartment 142 and the release valve 146 may be attached to or otherwise placed in flow communication with the fluid compartment 128 of the hydraulic mechanism 110. In embodiments in which the main opening 112 is temporarily covered, the cap 118 may be placed over the product material 104.

After assembly, the dispenser 100 may be used in the application of the product material to a user's skin. For example, during operation of the dispenser, the user may remove the cap 118 and depress the tab 108 to exert a downward force against the first piston 124. In response, the force from the first piston 124 is transmitted through the hydraulic fluid within the fluid compartment 128 to the second piston 126. In an embodiment, the pressure exerted by the first piston 124 causes the hydraulic fluid to flow into the interior chamber 136 of the second piston 126. The increased fluid pressure within the interior chamber 136 causes the second piston 126 to telescope toward an expanded configuration, with respect to the hollow shaft 134. As a result, the second piston 126 exerts an upward force against the platform 106 to advance the product material through the housing 102 to provide increased access to the product material for application to the user's skin. Alternatively, the user may force the tab 108 upward to exert an upward force against the first piston 124. In response, the force from the first piston 124 is transmitted through the hydraulic fluid within the fluid compartment 128 to the second piston 126. In an embodiment, the negative pressure exerted by the first piston 124 causes the hydraulic fluid to flow out of the interior chamber 136 of the second piston 126. The decreased fluid pressure within the interior chamber 136 causes the second piston 126 to telescope toward a contracted configuration, with respect to the hollow shaft 134. As a result, the second piston 126 exerts a downward force against the platform 106 to retract the product material into the housing 102.

Accordingly, improved mechanisms for dispensing a personal care product, such as an antiperspirant and/or deodorant, have been provided. The above-described dispensers may be easier to use than conventional rotatable handwheel configurations. Specifically, by providing a tab that is slidably engaged with a housing, users may simply manipulate the tab to advance or retract product material with respect to the dispenser. In addition, the improved mechanism may be configured such that the hydraulic mechanism and other components associated with the hydraulic mechanism (e.g. the tab and/or the overflow compartment) may be formed as a single component, which may simplify product manufacture.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A personal care product dispenser, comprising:

a housing having a main opening and an interior compartment;

a platform disposed within the interior compartment of the housing;

a personal care product disposed on the platform;

a hydraulic mechanism in operable communication with the platform; and a tab operatively coupled to the hydraulic mechanism, wherein the hydraulic mechanism is configured to exert a force against the platform to advance the platform and the personal care product through the interior compartment of the housing in response to user manipulation of the tab.

2. The dispenser of claim 1, wherein:

the housing includes a slot extending along a dimension of the housing, and the tab protrudes through the slot.

3. The dispenser of claim 1, wherein:

the hydraulic mechanism includes a first piston, a second piston, and a fluid compartment, the first piston operatively coupled to the tab and slidably engaged with the fluid compartment, the second piston operatively coupled to the platform and slidably engaged with the fluid compartment, the fluid compartment defining a channel extending between and providing fluid communication between the first piston and the second piston.

4. The dispenser of claim 3, wherein a portion of the fluid compartment is defined by a hollow shall, and the second piston is configured to slidably engage with and telescope with respect to the hollow shall to thereby move between a contracted configuration and an expanded configuration in response to user manipulation of the tab.

5. The dispenser of claim 4, wherein:

the fluid compartment includes hydraulic fluid, a first opening, and a second opening, the first piston communicates with the first opening, the second piston communicates with the second opening, and when the tab is manipulated by the user, a pressure is exerted on the first piston and the pressure causes the second piston to move from the contracted configuration toward the expanded configuration.

6. The dispenser of claim 1, wherein the personal care product is disposed in the interior compartment of the housing and comprises an antiperspirant or a deodorant.

7. The dispenser of claim 1, further comprising an overflow compartment and a release valve, the overflow compartment disposed proximate to the fluid compartment, and the release valve disposed between the overflow compartment and the hydraulic mechanism and configured to open in response to a pressure differential between the overflow compartment and the hydraulic mechanism that is greater than a threshold pressure.

8. The dispenser of claim 1, wherein the platform and the hydraulic mechanism comprise a single component.

9. A personal care product dispenser, comprising:

a housing having a main opening, an interior compartment, and a slot;

a platform disposed within the interior compartment of the housing;

a personal care product disposed on the platform;

a tab at least partially extending through the slot; and a hydraulic mechanism in operable communication with the platform and the tab, the hydraulic mechanism including a first piston, a second piston, and a fluid compartment, the first piston operatively coupled to the tab and slidably engaged with the fluid compartment, the second piston operatively coupled to the platform and slidably engaged with the fluid compartment, and the fluid compartment defining a channel extending and providing fluid communication between the first piston and the second piston, wherein the hydraulic mechanism is configured to exert a force against the platform to advance the platform and the personal care product through the interior compartment of the housing in response to user manipulation of the tab.

10. The dispenser of claim 9, wherein a portion of the fluid compartment is defined by a hollow shaft, and the second piston is configured to slidably engage with and telescope with respect to the hollow shall to thereby move between a contracted configuration and an expanded configuration in response to user manipulation of the tab.

11. The dispenser of claim 10, wherein:

the fluid compartment includes hydraulic fluid, a first opening, and a second opening, the first piston communicates with the first opening, the second piston communicates with the second opening, and when the tab is manipulated by the user, a pressure is exerted on the hydraulic fluid by the first piston, through the fluid compartment, and the pressure causes the second piston to move from the contracted configuration toward the expanded configuration.

12. The dispenser of claim 9, wherein the personal care product is disposed in the housing and comprises an antiperspirant or a deodorant.

13. The dispenser of claim 9, further comprising an overflow compartment and a release valve, the overflow compartment disposed proximate to the fluid compartment, and the release valve disposed between the overflow compartment and the hydraulic mechanism and configured to open in response to a pressure differential between the overflow compartment and the hydraulic mechanism that is greater than a threshold pressure.

14. A method of packaging a personal care product, the method including the steps of:

providing a housing having a main opening, an interior compartment, the personal care product, and a cover, the personal care product disposed in the interior compartment, and the cover disposed over the main opening; and inserting an encasement mechanism into the housing to enclose the personal care product within the housing, the encasement mechanism including a platform and a hydraulic mechanism, the encasement mechanism disposed such that the platform contacts the product material, and the hydraulic mechanism contacts the platform.

15. The method of claim 14, wherein the platform and the hydraulic mechanism comprise a single component.

16. The method of claim 14, further comprising loading a hydraulic fluid in the fluid compartment.

17. The method of claim 14, wherein:

the encasement mechanism includes an overflow compartment and a release valve, the overflow compartment disposed proximate to the fluid compartment, and the release valve disposed between the overflow compartment and the hydraulic mechanism and configured to open in response to a pressure differential between the overflow compartment and the hydraulic mechanism that is greater than a threshold pressure.

18. The method of claim 14, wherein:

the hydraulic mechanism includes a tab, a first piston, a second piston, and a fluid compartment, wherein the second piston is coupled to the platform and configured to move the platform through the housing, the fluid compartment defines a channel extending and providing fluid communication between the first piston and the second piston, and the method includes inserting the tab through a slot in the housing to connect with the first piston.

19. The method of claim 18, wherein:

a portion of the fluid compartment is defined by a hollow shaft, and the second piston is configured to slidably engage with and telescope with respect to the hollow shaft to thereby move between a contracted configuration and an expanded configuration in response to user manipulation of the tab.

20. The method of claim 19, wherein:

the fluid compartment includes hydraulic fluid, a first opening, and a second opening, the first piston communicates with the first opening, the second piston communicates with the second opening, and when the tab is manipulated by the user, a pressure is exerted on the hydraulic fluid by the first piston and the pressure causes the second piston to move from the contracted configuration toward the expanded configuration.

* * * * *